US005294096A

United States Patent [19]

Müller

[11] Patent Number: 5,294,096

[45] Date of Patent: Mar. 15, 1994

[54] POWER SUPPLY COIL FOR THE CERAMIC-FREE OUTLET OF A MELTING POT

[75] Inventor: Felix Müller, Biebergemünd, Fed. Rep. of Germany

[73] Assignee: Leybold Durferrit GmbH, Cologne, Fed. Rep. of Germany

[21] Appl. No.: 868,542

[22] Filed: Apr. 14, 1992

[30] Foreign Application Priority Data

Dec. 10, 1991 [DE] Fed. Rep. of Germany ..... 4140723

[51] Int. Cl.[5] ..... B22D 41/60

[52] U.S. Cl. ..... 266/237; 266/236

[58] Field of Search ..... 266/237, 236; 373/142, 373/152, 160; 219/553, 420

[56] References Cited

U.S. PATENT DOCUMENTS 2,825,033 10/1958 Rudd et al. ..... 336/58
4,428,894 1/1984 Bienvenu ..... 264/9
4,987,951 1/1991 Dietrich et al. ..... 164/466

FOREIGN PATENT DOCUMENTS 0365027 4/1981 Austria .
1018650 10/1957 Fed. Rep. of Germany .
1147714 8/1958 Fed. Rep. of Germany .
4011392 10/1991 Fed. Rep. of Germany .
6000529 1/1976 Japan ..... 266/237
1-298103 12/1989 Japan .
2-43305 2/1990 Japan .
1388183 4/1988 U.S.S.R. .

*Primary Examiner*—Scott Kastler
*Attorney, Agent, or Firm*—Felfe & Lynch

[57] ABSTRACT

The feed line (7) and the return line (8) are combined to a single current supply line (6) at one end of the coil which leads to the first turn sections connected to the opposite end of the coil. Second turn sections running back to the supply line (6) are radially opposed from respective first turn sections.

6 Claims, 1 Drawing Sheet

POWER SUPPLY COIL FOR THE CERAMIC-FREE OUTLET OF A MELTING POT

BACKGROUND OF THE INVENTION

The invention relates to a coil for a melting pot with a ceramic-free outlet for the purpose of letting off a stream of molten metal. This coil is equipped with turns conducting electricity supplied by means of a feed line and a return line.

In the ceramic-free discharge of a stream of molten metal where the outlet that the melt flows through is formed by individual metal palisades that are surrounded by the coil, problems occur with known coil due to the high amount of power required to be introduced into the stream of melt since the shape of the coil and its current supply causes the power supply to be unsymmetrical and therefore inhomogeneous. This results in a deflection of the liquid stream of melt due to the magnetic fields of the coil. Such a deflection of the metal stream is undesirable in the case of subsequent further processing of the metal stream into powder or into a dead-mold casting or even prevents subsequent processes altogether.

Up to this point attempts were made to minimize the effect of a deflected stream of metal by using an additional compensating turn, by modifying the height between the turns of the coil or by changing the diameter of the coil locally. Furthermore, attempts have been made to locate bodies made from special magnetic alloys in the area of the outlet in order to compensate for such non-homogeneities in the magnetic field. The known processes, however, are always combined with a reduction of the effectiveness of the system and therefore do not solve the problem.

The invention is based on developing a coil of the previously mentioned type that allows for a high supply of power while maintaining a highly homogenous magnetic field.

The feed line and the return line are combined into one single current supply line in the area of the front side of the coil and this current supply line leads directly up to the turns. The turns run from that side of the coil that is located axially opposite to the current supply back to the return line in symmetrical arrangement to the turns leading to this front side.

Such a coil makes a coaxial current supply possible. Inside the turns of the coil, the current is distributed symmetrically due to the geometry of the semi-circular turn sections. This results in a magnetic field in the coil that is symmetrical to its center line which prevents a lateral deflection of the metal stream.

The coil as laid out by the invention can have several design variations. If the objective is to supply high levels of power into the liquid stream of metal without magnetic forces influencing the flow speed of the metal stream, the coil can be produced in a particularly cost-saving manner if the turns, coming from the feed line, initially form an almost semi-circular turn section, then a short connecting section running in the direction of the axis, after which another, almost semi-circular turn section with opposite direction of rotation (phase sequence) follows (FIG. 2).

Another condition is that the two axial connecting sections are connected by a turn circle that is almost a full circle on the side that is facing away from the current supply after a desired number of turn sections which are connected by the connecting sections that are oriented in axial direction and that the turn then runs toward the return line in symmetrical arrangement to the remaining turns.

If one intends to control the discharge of the metal in order to control the progression of a remelting process by means of magnetic forces that act upon on a metal stream, then a coil is beneficial which is distinguished by the fact that an almost semi-circular turn section is located adjacent to the power supply which is followed by a second, almost semi-circular turn section with the same orientation (phase sequence) that runs at a different height as a result of the oblique connecting section and if the turns run back to the return line after a desired number of turn sections from the far front side that is facing away from the power supply in symmetrical arrangement to the turns that lead to the opposite front side (FIG. 3).

A possible elliptic deformation of the metal stream due to the difference in height of the turn sections that are located opposite each other by 180° can be minimized by providing, in accordance with another variation of the invention, a field weakening at the 90° and 270° positions respectively at the areas located between the two connecting sections. The remaining non-homogeneity of such a coil is located in the end area of the coil and does not have a negative effect there.

Another possibility of compensating non-homogeneities of the magnetic field is to vary the position and/or number of the palisades.

The invention allows for numerous variations. In order to explain it in more detail, two of these variations are illustrated in the diagram and will be described in the following.

DETAILED DESCRIPTION OF THE PREFERRED EMBODIMENTS

Figure 1:
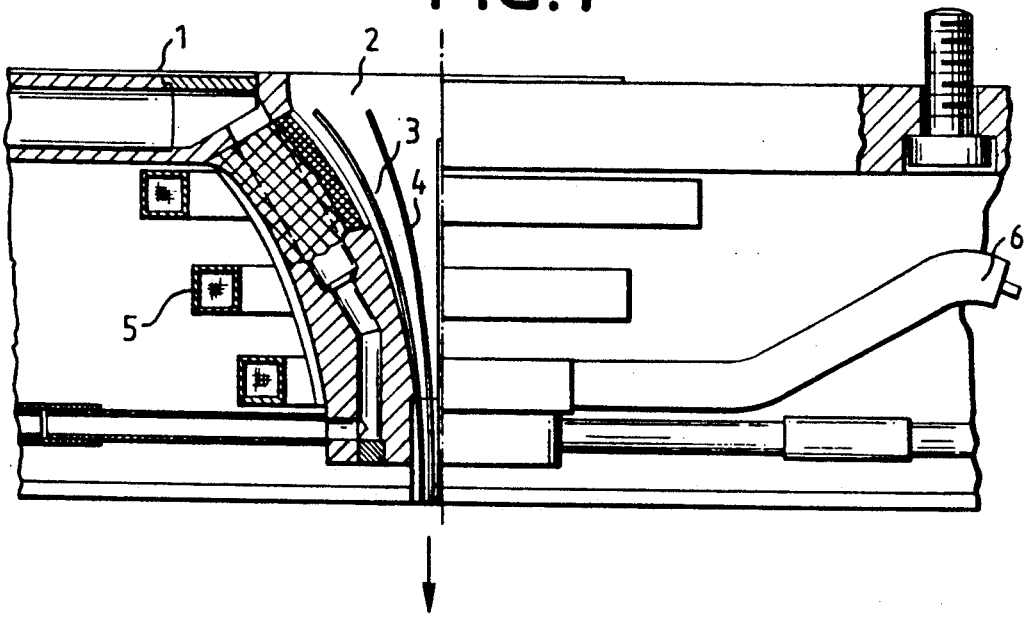
FIG. 1 is a partially sectioned side view of a stream guiding system with a conventional helical coil.

FIG. 1 shows a portion of a bottom 1 of a melting pot that has a funnel-shaped outlet 2 which is formed by several metal palisades 3, 4 that are located adjacent to each other, with small distances between them. The outlet 2 is surrounded by a coil 5 which is provided with a current supply 6 that is formed by a coaxial cable.

Figure 2:
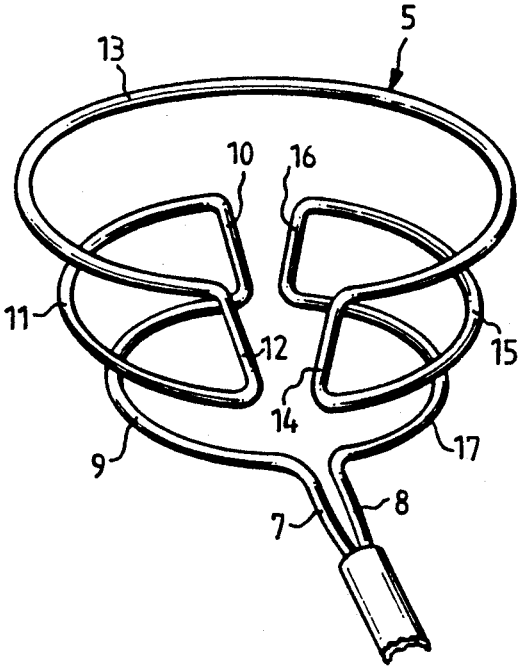
FIG. 2 is a perspective of a first design variation of a coil in accordance with the invention.
Figure 3:
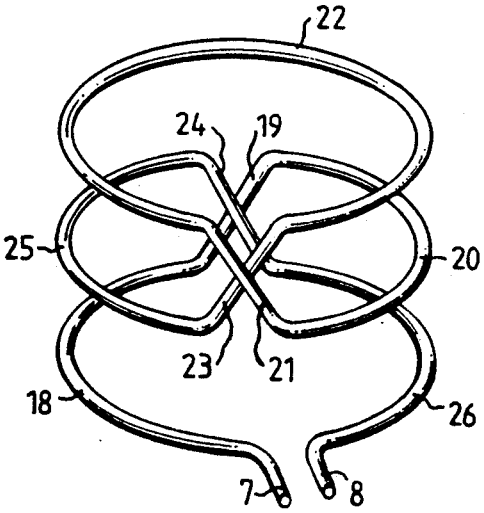
FIG. 3 shows a perspective illustration of a second design variation of the coil.

Referring to FIGS. 2 and 3, the inventive coil 5 has a symmetrical design so that a metal stream flowing out of outlet 2 is not laterally deflected.

The coil 5, illustrated perspectively in FIG. 2, has a feed line 7 and a return line 8 that are provided from coaxial power cable 6. Feed line 7 leads into an almost semi-circular turn section 9. It leads into an axial short connecting section 10 which is directed vertically upwards which leads into another turn section 11 that runs in the opposite direction (with opposite phase sequence) as turn section 9 and is also almost semi-circular.

At the end of turn section 11, again a short connecting section 12 of axial direction is provided. From this connecting section 12 an almost circular turn section 13 leads to a connecting section 14 of downward direction which is parallel to connecting section 12. This leads into a semi-circular turn section 15 which is symmetrical to turn section 11, followed by another connecting section 16 with downward direction and at the end it is again followed by an almost semi-circular turn section 17 which leads into return line 8.

In the case of coil 5, as shown in FIG. 2, the direction of the current changes from turn section 9, 11 and/or 15, 17 of each side. This can be avoided by the variation of the invention as shown in FIG. 3. Exactly as in the case of the previously described coil 5, first a turn section 18 runs from a feed line 7 in almost semi-circular arrangement. Then, a connecting section 19 runs upwards at an angle toward the side that is radially opposite where a turn section 20 with the same direction (phase sequence) follows which is also almost semi-circular. It is followed by another connecting section 21 that runs upwards at an angle and by a section 22 that almost forms a full circle. From there, the coil 5 runs symmetrical to the sections described so far toward return line 8 with connecting sections 23, 24 and turn sections 25, 26.

It should be noted that the coil can have an opposite arrangement than shown in the figures, with feed line 7 and return line 8 at the top. The shape of the coil will generally conform to the shape of the outlet, the funnel shaped coil of FIG. 2 being suitable for a funnel shaped outlet as in FIG. 1. The cylindrical coil of FIG. 3 would be more suitable for a cylindrical outlet.

I claim:

1. An electrical power supply coil for the ceramic free outlet of a melting pot, said coil comprising a top end, a bottom end, and a central axis extending between said ends, a coaxial power supply cable which provides a feed line and a return line at one of said top and bottom ends, a plurality of electrically continuous first turn sections at successive levels between said ends, said first turn sections being supplied by said feed line, connecting sections connecting said first turn sections between said successive levels, a like plurality of electrically continuous second turn sections at successive levels between said ends, each second turn section being radially opposed to one of said first turn sections, said second turn sections being connected to said first turn sections only at the other of said first and second ends and connected to said return line at said one end, and connecting sections connecting said second turn sections between said successive levels.

2. An electrical power supply coil as in claim 1 wherein said first turn sections are all located on one side of said axis, while the second turn sections are all located on the opposite side of said axis, whereby electrical current at successive levels in either of said first and second turn sections flows in opposite circumferential directions.

3. An electrical power supply coil as in claim 1 wherein said first turn sections at successive levels are located on opposite sides of said axis and said second turn sections at successive levels are located on opposite sides of said axis, whereby electrical currect at successive levels in either of said first and second turn sections flows in the same circumferential direction.

4. Apparatus for stabilizing a stream of molten metal, said apparatus comprising a funnel shaped ceramic free outlet surrounded by a coil having a vertical axis, said coil comprising a top end, a bottom end, and a central axis extending between said ends, a coaxial power supply cable which provides a feed line and a return line at one of said top and bottom ends, a plurality of electrically continuous first turn sections at successive levels between said ends, said first turn sections being supplied by said feed line, connecting sections connecting said first turn sections between said successive levels, a like plurality of electrically continuous second turn sections at successive levels between said ends, each second turn section being radially opposed to one of said first turn sections, said second turn sections being connected to said first turn sections only at the other of said first and second ends and connected to said return line at said one end, and connecting sections connecting said second turn sections between said successive levels.

5. Apparatus as in claim 4 wherein said first turn sections are all located on one side of said axis, while the second turn sections are all located on the opposite side of said axis, whereby electrical current at successive levels in either of said first and second turn sections flows in opposite circumferential directions.

6. Apparatus as in claim 4 wherein said first turn sections at successive levels are located on opposite sides of said axis and said second turn sections at successive levels are located on opposite sides of said axis, whereby electrical current at successive levels in either of said first and second turn sections flows in the same circumferential direction.

* * * * *